United States Patent [19]

Chapman et al.

[11] 4,211,172

[45] Jul. 8, 1980

[54] APPARATUS FOR CONNECTING TOW CARTS TO A CONVEYOR

[75] Inventors: Walter H. Chapman, Beachwood, N.J.; David E. Hiland, Seaford, Del.; Erwin B. Knies, Norristown, Pa.; Robert E. Oberlin, Wilmington, Del.

[73] Assignee: E. I. Du Pont de Nemours and Company, Wilmington, Del.

[21] Appl. No.: 892,404

[22] Filed: Mar. 31, 1978

[51] Int. Cl.[2] ..... B61B 13/12; B65G 17/42

[52] U.S. Cl. ..... 104/172 BT; 104/178

[58] Field of Search ..... 104/172 BT, 172 R, 172 S, 104/162

[56] References Cited

U.S. PATENT DOCUMENTS

| | | | |
|---|---|---|---|
| 2,971,474 | 2/1961 | Klamp | 104/172 S |
| 3,091,191 | 5/1963 | Fur | 104/178 |
| 3,161,145 | 12/1964 | Gavgill et al. | 104/178 |
| 3,565,012 | 2/1971 | Nearman | 104/172 S |
| 3,653,328 | 4/1972 | Abram et al. | 104/172 BT |
| 3,973,503 | 8/1976 | Parker et al. | 104/172 BT |

FOREIGN PATENT DOCUMENTS

| | | | |
|---|---|---|---|
| 811672 | 4/1959 | United Kingdom | 104/172 BT |
| 524744 | 5/1973 | U.S.S.R. | 104/172 BT |

*Primary Examiner*—Stephen G. Kunin
*Assistant Examiner*—Lawrence E. Williams

[57] ABSTRACT

An apparatus for transmitting force between a tow cart and an in-floor conveyor that includes a pin that pivots out of engagement with the conveyor when the cart meets an obstruction. The motion of the pin when disengaging from the conveyor places another pin in position to engage another drawing position of the conveyor. The pins are movable along their longitudinal axes to follow the profile of the conveyor when moving into and out of engagement with it.

4 Claims, 11 Drawing Figures

APPARATUS FOR CONNECTING TOW CARTS TO A CONVEYOR

DESCRIPTION

1. Technical Field

This invention relates to tow line conveyor systems for wheeled carts and more particularly to an apparatus for connecting the carts to the conveyor.

2. Background Art

Tow line conveyor systems for wheeled carts are known in which a number of carts are driven by a below floor level conveyor system that is engaged by a pin which extends from a location on the bottom of the cart through a slot in the floor. The sub floor systems usually provide for lifting the pin out of engagement with the conveyor as disclosed in U.S. Pat. No. 3,973,503. An apparatus that provides a combination of rotating and reciprocating motion of the pin for disengaging then engaging with a moving conveyor is disclosed in U.S. Pat. No. 3,091,191.

DISCLOSURE OF THE INVENTION

The apparatus according to the invention is constructed in a system for propelling wheeled carts positioned over the conveyor and adjacent thereto for movement by said conveyor and is an apparatus for transmitting force between the conveyor and the cart. The apparatus comprises a frame attached to said cart between the cart and the conveyor; a pair of hubs mounted to the frame on axes transverse to the movement of the conveyor; means for providing counter rotary movement to one hub with respect to the other; each hub having a pin extending radially from its axes with the pins being slideably mounted to the hubs for radial movement with respect to said axes, one of said pins at a time being rotatable into position to act as a force transmitting member between said conveyor and the cart; means for applying a predetermined force to one of said pair of hubs to resist rotary movement of the hubs, said hubs having rotary movement imparted thereto when said carts meet an obstruction overcoming the predetermined force applied to the hubs to resist rotary movement of the hubs, said pins moving toward and away from said axes according to the profile of the conveyor when rotary movement is imparted to the hubs.

BEST MODE

Figure 1:
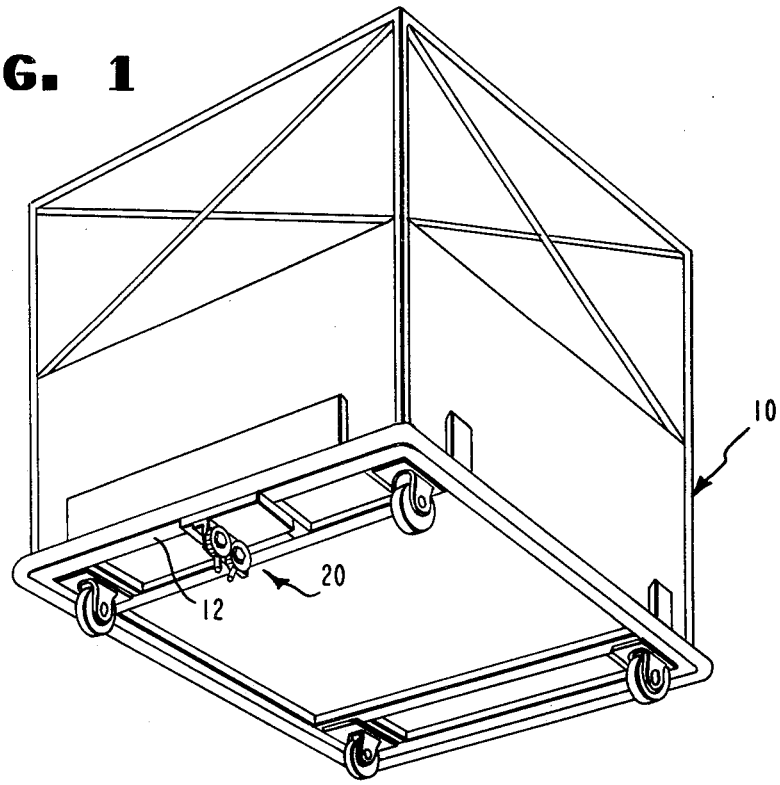
FIG. 1 is a perspective view of the underside of a wheeled cart equipped with the apparatus of the present invention.

Referring to FIG. 1 the apparatus of this invention generally designated as 20 is shown attached to the frame 12 on the underside of wheeled cart 10. The apparatus 20 is used to connect the cart 10 to a drag chain conveyor 14. This structure and its operation can best be understood by referring to FIGS. 2–4 wherein the wheeled cart 10 rests on floor 13 having a slot 15 in which the drag chain 18 is moving in the direction shown by the arrow on the chain. The chain 18 consists of two kinds of alternating links; one type has **18*a* has a flat top surface 17 and a second type 18*b* has a depression 19 for receiving the pin portion of apparatus 20**.

The apparatus 20 embodies a bracket-like frame 24 attached to frame 12 of the cart 10, and a pair of intermeshed gears 26, 28 mounted on one end of shafts 27, 29 respectively. The shafts 27, 29 are rotatable in frame 24 and have axes which are parallel to each other and transverse to the direction of motion of chain 18. Pins 22 and 23 are slideable in bores in the hubs of gears 26, 28 as for example, bore 31 shown in FIG. 3. The pins are biased outwardly from the gear by springs (e.g. 33 FIG. 3) positioned behind respective pins in bores in the hubs of the gears and are retained in the bores by pins **32*a* engaging the reduced portion 33*a* of the pins. On the other end of shaft 29 is a device for regulating the thrust force between the chain and the cart and in this instance the device is a friction clutch comprising a spring washer 34 pressing a friction surface 35 against the outside surface of frame 24. Nut 36 threaded to shaft 29 adjusts the friction force required to turn the gears 26, 28 which in turn governs the thrust force to release pins 22, 23 from the drag chain 18. The friction clutch may be on either shaft 27 or 29** and one clutch is essential for most applications.

Figures 2, 3, 4:
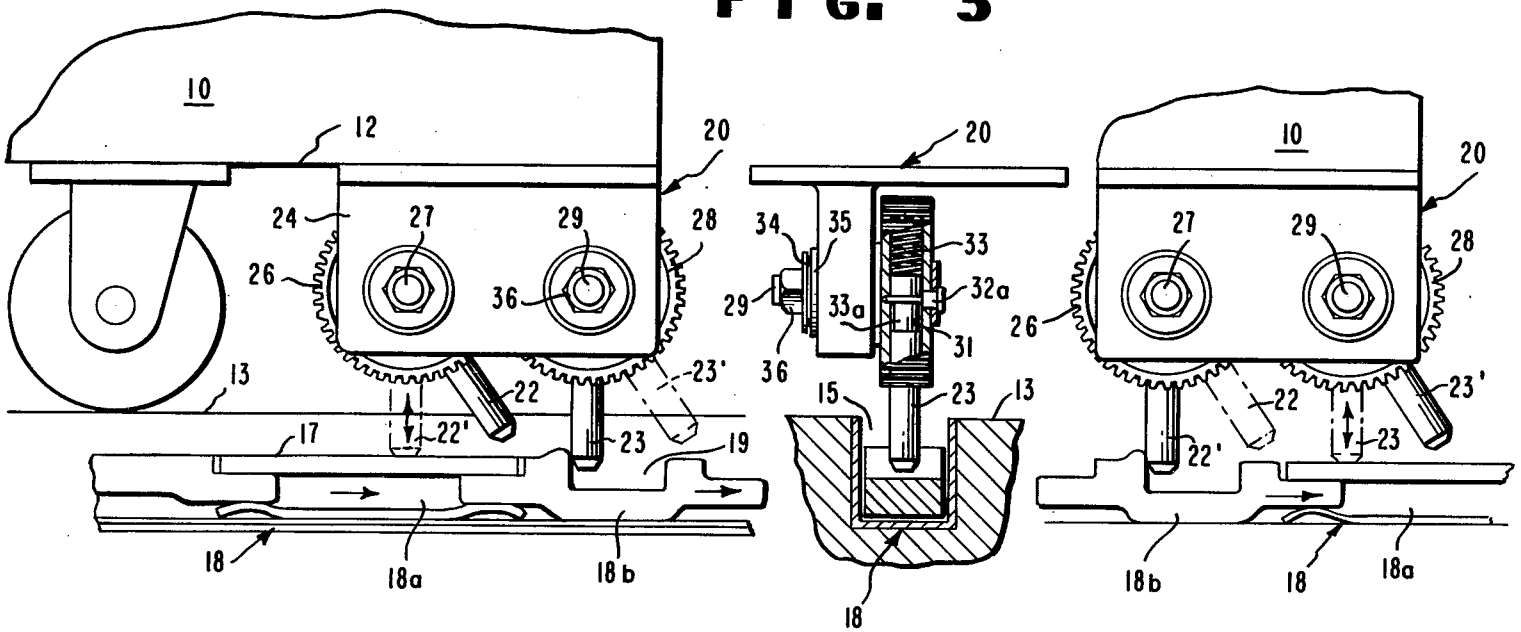
FIG. 2 is a side elevation view of the apparatus of the invention in a first operating position.
FIG. 3 is an end view of FIG. 2 partially in section.
FIG. 4 is a view similar to FIG. 2 in a second operating position.

In operation, when cart 10 meets an obstruction, gear 28 and pin 23 turn to position 23' as soon as the preset force applied by spring washer 34 is exceeded, thus disconnecting cart 10 from the chain 18 permitting the cart to stop. Inasmuch as gear 28 is intermeshed with gear 26, pin 22 which was positioned above chain 18 is simultaneously moved with gear 26 to the position indicated for pin 22' encountering the flat surface 17 of chain 18 which causes the pin 22' to move upward into the bore in gear 26 until the chain 18 moves another depression 19 under the pin 22' at which time pin 22' moves downward under the urging of a spring behind the pin and is engaged by the moving chain 18. If the cart is still obstructed the cycle will be reversed as shown in FIG. 4. More particularly, gears 26, 28 will turn counterclockwise and clockwise respectively allowing pin 22' to move to position 22 while the other pin 23' moves to position as indicated by 23 where it rides up over the flat surface 17 of chain 18 until the next depression 19 appears at which time pin 23 then moves into the depression and is engaged by the chain.

Figures 5, 6, 7:
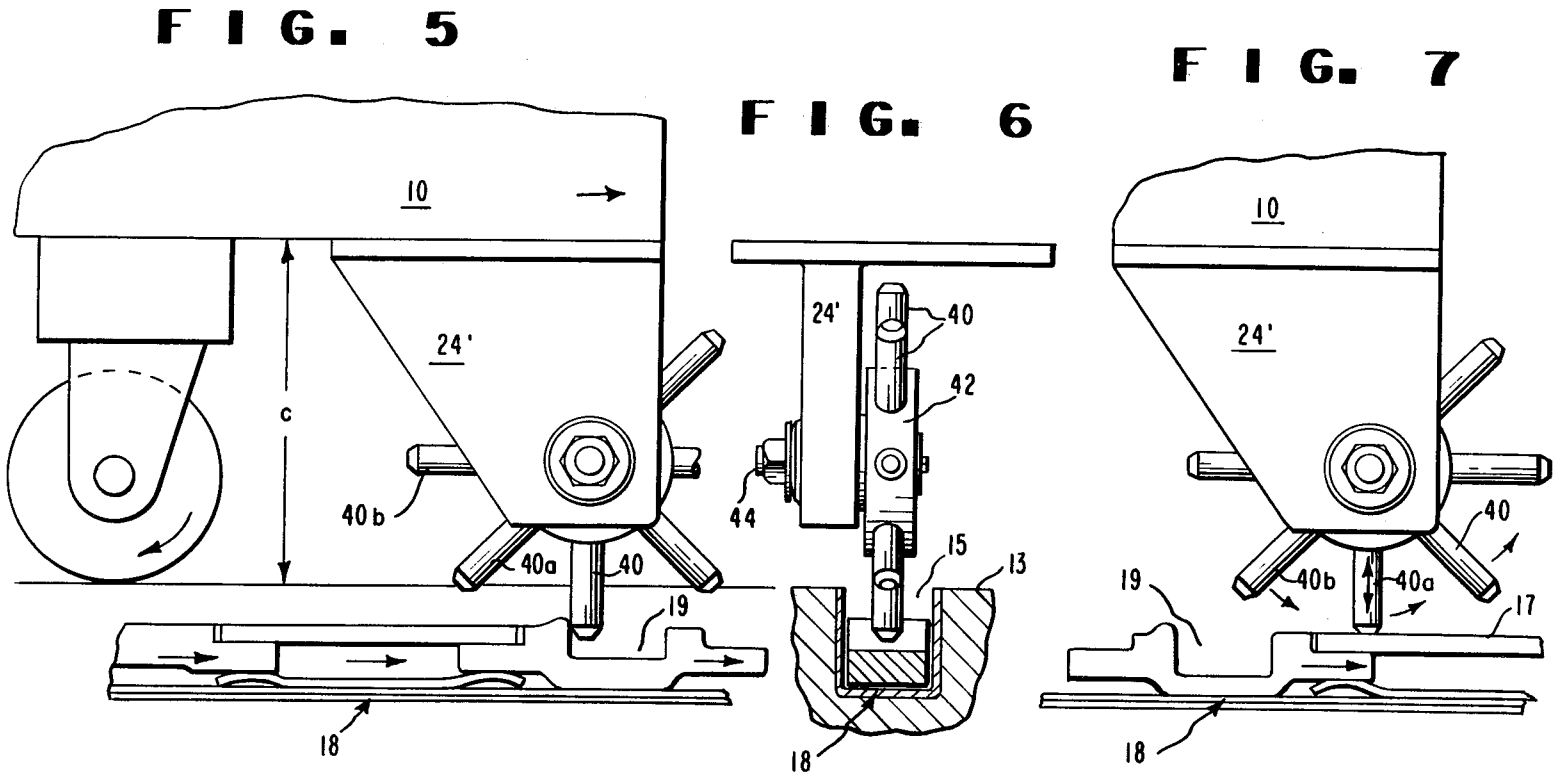
FIG. 5 is a side elevation view of an alternate embodiment in a first operating position.
FIG. 6 is an end view of FIG. 5.
FIG. 7 is a view similar to FIG. 5 in a second operating position.

In an alternate embodiment shown in FIGS. 5–7 the linking mechanism between the cart 10 and the chain 18 consists of a plurality of pins 40 located around a hub 42 rotatably mounted on a shaft 44 in bracket 24' attached to frame 12 of cart 10. The pins are slideably mounted in hub 42 for radial movemment with respect to shaft 44. A friction clutch comprising spring washer 34 as previously described governs the thrust force to release pins 40 from chain 18 when the cart meets an obstruction. In operation, as soon as the preset force is exceeded the cart stops and pin 40*a* moves to the position formerly occupied by pin 40. Pins 40*a* and 40 are free to move radially toward the shaft 44 according to the profile of chain 18 as rotary movement is imparted to the hub 42. The rotary movement of the hub 42 ceases when pin 40 clears the chain 18 and pin 40*a* is riding on top of the chain (FIG. 7). Then when the chain moves the next depression 19 under pin 40*a*, a force will be exerted on the cart. If the obstruction has been removed the cart will move on. If the cart is still obstructed then the cycle as described above will repeat.

Figure 8:
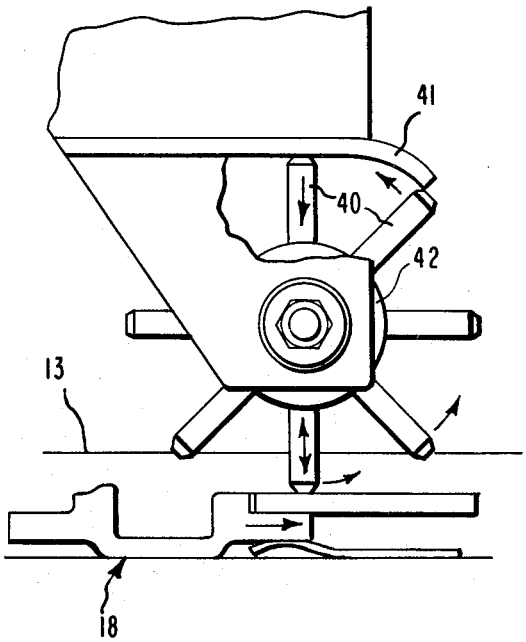
FIG. 8 is a side elevation view of another alternate embodiment.

The arrangement shown in FIGS. 5–7 may be used where there is sufficient clearance C (FIG. 5) between the floor 13 and the underside of the cart. Where somewhat less height is available as in FIG. 8 a camming surface 41 may be attached to the underside of cart 10 to move pins 40 radially into hub 42 as they reach the top of their movement around shaft 44.

It should be recognized that where still less clearance is available the preferred embodiment (FIGS. 2–4) which does not require complete rotary movement around the hub has a decided advantage.

Figure 9:
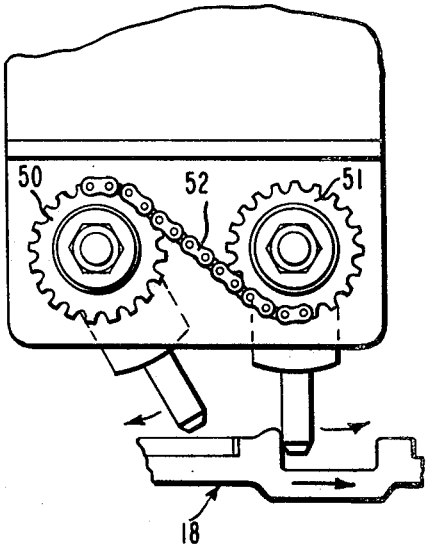
FIG. 9 is a side elevation of still another alternate embodiment.

Although the preferred embodiment includes two meshed gears 26, 28, the same results (i.e. counter rotating movement) can be obtained by other equivalent mechanical linkages such as sector gears or as shown in FIG. 9 by two sprockets 50, 51 having a roller chain 52 interconnecting the two to impart counter rotating movement to one sprocket with respect to the other.

Figure 10:
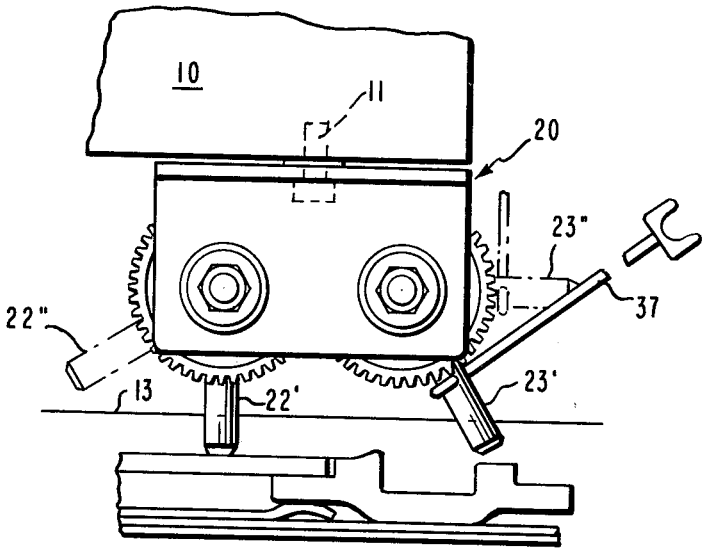
FIG. 10 is a side elevation view of the apparatus of FIG. 2 showing one way to disengage the apparatus from the track slot.
Figure 11:
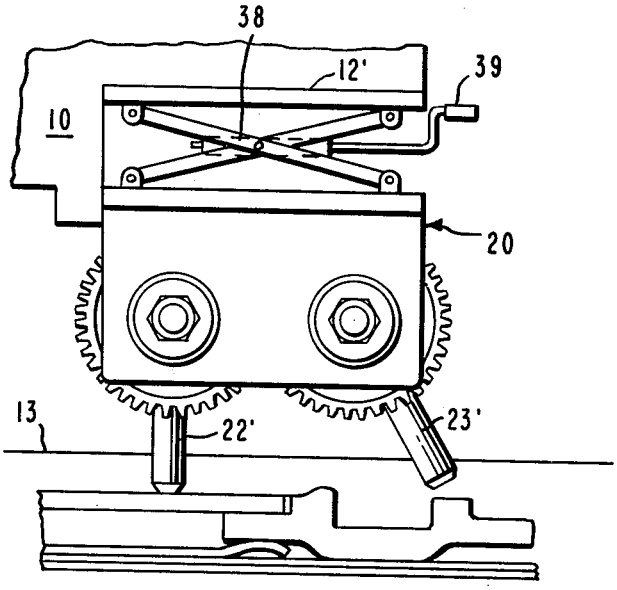
FIG. 11 is a side elevation of an alternate embodiment useful for engaging and disengaging the apparatus of the invention.

Various alternate methods and apparatus can be used to disengage the apparatus 20 from the track slot 15 and elevate its pins 22 and 23 above the floor 13 for occasional manual handling. For example, as shown in FIG. 10, a simple tool 37 can be provided to rotate pin 23 upward from position 23′ to position 23″ by using the hook-shaped end of tool 37. Pulling on the tool as indicated by the arrow will cause gear 28 to rotate gear 26 such that pin 22 will rotate from position 22′ to position 22″, thereby disengaging the apparatus. The reverse procedure and the "U" shaped end of tool 37 are used to return pin 23″ to position 23′ and thereby re-engage the apparatus. FIG. 11 shows an apparatus to disengage apparatus 20 from the track slot 15 in the form of a scissors lift attachment 38 which can be used with any of the embodiments illustrated. It requires the frame 12 to be indented to position 12′. To disengage/re-engage apparatus 20, it is merely necessary to crank the handle 39 attached to the scissors lift 38 in the appropriate direction.

Additionally the friction clutch described herein may be of another mechanical arrangement such as a spring-loaded ball fitting into a detent. The ball and detent arrangement being particularly useful where variations in the distance between the conveyor claim 18 and the cart 10 may cause the pins to move different amounts at different places along the conveyor route, in which case the ball and detent can be used to position the next pin at a precise location.

The friction clutch has been illustrated as associated with shaft 29, however, it may be associated with either shaft 27 or 29 or a friction clutch may be associated with each shaft.

Various alternate methods can be used to attach the apparatus 20 to the frame 12 which will permit the apparatus 20 to swivel in order to negotiate tight radius turns (i.e., <12″ radius). One such swivel arrangement is shown in FIG. 10 wherein the apparatus 20 can pivot with respect to the frame 12 about pivot point 11.

While the invention has been disclosed in connection with a cart on a floor, the principles of the invention are considered to be applicable as well to a suspended cart system.

I claim:

1. In a system for propelling wheeled carts, that includes a moving conveyor and a wheeled cart positioned over said conveyor and adjacent thereto for movement by said conveyor, an apparatus for transmitting force between said conveyor and said cart, said apparatus comprising: a frame attached to said cart between the cart and the conveyor; a pair of hubs mounted to said frame on axes transverse to the movement of the conveyor; means for providing counter rotary movement to one hub with respect to the other; each hub having a pin extending radially from its axis with the pins being slideably mounted to the hubs for radial movement with respect to said axes, one of said pins at a time being placed to act as a force transmitting member between the conveyor and the cart by rotary movement of the other; means for applying a predetermined force to one of said pair of hubs to resist rotary movement of said hubs, said hubs having rotary movement imparted thereto when said cart meets an obstruction overcoming the predetermined force applied to the hubs, said pins moving toward and away from said axes according to the profile of the conveyor when rotary movement is imparted to the hubs.

2. In a system for propelling wheeled carts that includes a moving conveyor and a wheeled cart positioned over said conveyor for movement by said conveyor, an apparatus for transmitting force between the conveyor and the cart, said apparatus comprising: a frame attached to said cart between the cart and said conveyor, a hub mounted to said frame for rotary movement on an axis transverse to the movement of said conveyor, a plurality of pins spaced around said hub, said pins being slideably mounted to the hubs for radial movement with respect to said axis, one of said pins at a time being placed to act as a force transmitting member between the conveyor and the cart; means for applying a predetermined force to resist rotary movement of said hub, said hub being rotated when said cart meets an obstruction overcoming the predetermined force applied to the hub and said pins having movement toward and away from said axis according to the profile of the conveyor when said predetermined force is exceeded to enable each succeeding pin to be placed to act as a transmitting force between said conveyor and said cart whereby the motion of one pin when disengaging from the conveyor place another pin in position to engage said conveyor.

3. The apparatus as defined in claim 1 or claim 2, said means for applying a predetermined force to resist rotary movement of said hub being a friction clutch mounted between said hub and said frame.

4. The apparatus as defined in claim 1 or claim 2 including means for urging said pins away from said axis and stop means for retaining said pins in said hub.

* * * * *